United States Patent [19]

Somoza et al.

[11] Patent Number: 5,020,731

[45] Date of Patent: Jun. 4, 1991

[54] PROCESS FOR REDUCING ACIDITY OF UNRECRYSTALLIZED EXPLOSIVES BY WET GRINDING

[75] Inventors: Carlos Somoza; Lee C. Estabrook, both of Minden, La.

[73] Assignee: Thiokol Corporation, Ogden, Utah

[21] Appl. No.: 549,286

[22] Filed: Jul. 6, 1990

[51] Int. Cl.[5] ..... B02C 19/00

[52] U.S. Cl. ..... 241/1; 241/21; 241/24; 149/92; 149/109.6; 564/107

[58] Field of Search ..... 241/1, 21, 24; 149/92, 149/109.6; 264/3.4, 3.5, 3.6; 564/107

[56] References Cited

U.S. PATENT DOCUMENTS

| | | | |
|---|---|---|---|
| 2,204,059 | 6/1940 | Acken | 564/107 |
| 3,239,502 | 3/1966 | Lee et al. | 260/583 R |
| 3,351,585 | 11/1967 | Lee et al. | 564/107 |
| 3,600,477 | 8/1971 | Friedel et al. | 241/21 |
| 3,770,721 | 11/1973 | Robbins et al. | 149/92 |
| 4,156,593 | 5/1979 | Tarpley, Jr. | 241/20 |
| 4,572,439 | 2/1986 | Pitzer | 241/21 |
| 4,767,064 | 8/1988 | Resch | 241/21 |

*Primary Examiner*—Stanley Silverman
*Assistant Examiner*—Neil M. McCarthy
*Attorney, Agent, or Firm*—Trask, Britt & Rossa

[57] ABSTRACT

Occluded acidity in particulate explosives is removed by slurrying the particles in an inert liquid and subjecting the slurry to wet-grinding. The inert liquid may include an alkaline salt at or near saturation. Separation of the ground explosive particles from the liquid phase results in a ground explosive material with much reduced acidity.

15 Claims, 4 Drawing Sheets

PROCESS FOR REDUCING ACIDITY OF UNRECRYSTALLIZED EXPLOSIVES BY WET GRINDING

BACKGROUND OF THE INVENTION

1. Field of the Invention

This invention relates to the production of high explosive materials. More particularly, the invention relates to the removal of excess acidity from crude unrecrystallized nitramines and other explosive materials.

2. State of the Art

Conventional methods of producing nitramine explosive materials typically result in the occlusion of acids in the crude crystals. For some nitramines, the acid must be largely removed to permit the materials to meet government specifications for use in explosives and propellants. The crude unrecrystallized material may contain occluded acidity which is 10 to 50 times the allowable specified acidity.

The procedure presently used for removing the excess occluded acidity comprises dissolving the crude material in an appropriate solvent and recrystallizing the nitramine, whereby most of the acidity remains in the solvent phase. However, this process is very slow and expensive. Moreover, the mean particle size and the particle size distribution may vary widely from batch to batch.

Typically, the recrystallized material must be further ground to a small particle size before use. For example, the high explosive cyclo-1,3,5-trimethylene-2,4,6-trinitramine (RDX) is graded for differing uses according to the particle size. Class 1 RDX has a relatively large particle size:

| U.S. Standard Sieve No. | Percent Passing |
|---|---|
| 20 | 98 +/− 2 |
| 50 | 90 +/− 10 |
| 100 | 60 +/− 30 |
| 200 | 25 +/− 20 |

A finely ground RDX, in which 97+ percent passes a No. 325 sieve, is designated Class 5 RDX.

A present grinding method using a fluid energy mill requires a moisture content less than about 0.1 percent. Thus, the wet recrystallized nitramine(s) must be first dried. Such drying at a relatively low temperature is a slow and energy intensive process.

Thus, starting with a crude slurry of crystallized RDX, the conventional steps required to produce Class 5 RDX ready for compounding into an explosive end product include:

1. dissolution in acetone at 135 degrees F.;
2. recrystallization by adding water and distilling the acetone at 86 degrees F.;
3. settling and decantation of the liquor;
4. adding water and distilling the remaining acetone;
5. dewatering of the slurry to recover RDX;
6. water-washing of recovered RDX.

The entire process is tedious and excessively consumptive of both time and energy.

Similar time consuming steps are used in the production of other explosive materials such as cyclotetramethylenetetranitramine (HMX), coproduced mixtures of RDX and HMX known as CPX, and other explosive materials, to achieve the desired low-acidity products.

There remains the need for a method which will rapidly and inexpensively remove the occluded and surface acidity of explosive materials to a low level. The need exists for a method which achieves the desired particle size reduction as well as acidity removal.

SUMMARY OF THE INVENTION

The invention is a method for removing occluded acidity from unrecrystallized explosive material from which such acidity must be removed. The invention will be exemplified in the removal of occluded and surface acidity from a nitramine such as RDX, HMX, or mixtures thereof.

In the invention, the crystalline nitramine containing excessive acidity is slurried in an inert liquid carrier or medium, and ground to the desired particle size while in the wet state. The slurry medium may be water alone, but preferably includes an alkaline buffering agent which enhances removal of the acidity by neutralization, and also increases the rate at which the particle size is reduced. Exemplary buffering agents are sodium carbonate, sodium bicarbonate and tris(hydroxymethyl-)amino methane.

Grinding of the unrecrystallized particles of nitramine as a liquid slurry releases the occluded acidity from the crude crystalline nitramine.

Any wet-grinding method may be used for the purpose of this invention, provided that it safely achieves the desired particle size. Thus, for example, a presently used method comprising the recirculating of a slurry in a piping system which includes a pump or pumps as well as pressure-reduction means, may be used. A preferred grinding method used in this invention is a sonification procedure described in concurrently filed application Ser. No. 07/549,449 of Carlos Somoza titled "Ultrasonic Grinding of Explosives," incorporated herein by reference. Ultrasonic grinding is conducted by passing the slurry of particulate explosive material proximate an ultrasonic wave generator which is operating at an output frequency of 14 to 60 KHz and at an acoustic power output which creates cavitation in the liquid. Preferably, the generator is operating at a frequency of 14–30 KHz, and an output power intensity of 70–120 watts/square cm.

Recovery of the ground, neutralized particles of nitramine without further recrystallization may be accomplished by decantation and/or filtration and optional washing of the ground explosive particles, for example.

In many cases, the explosive material is to be incorporated into the final product, such as an explosive composition for blending or compounding in ammunition in the wet state. In such cases, drying of the neutralized explosive material is unnecessary. The wet-ground explosive may then be simply water washed in preparation for blending.

DESCRIPTION OF THE PREFERRED EMBODIMENTS

Figure 1:
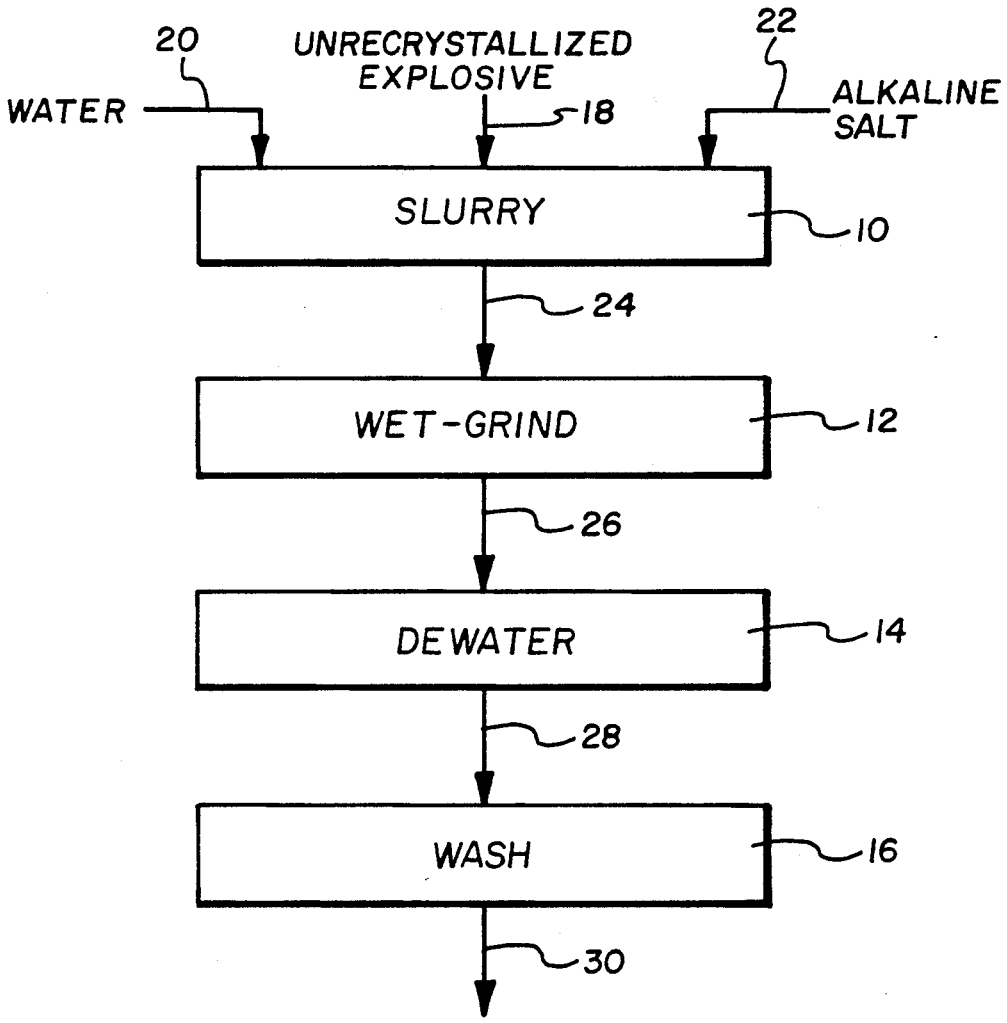
FIG. 1 is a schematic diagram of an acid removing process of this invention.

As illustrated in FIG. 1, the method of this invention comprises a slurrying step 10, a wet-grinding step 12, a dewatering step 14 and a washing step 16.

Unrecrystallized explosive material 18 which contains excessive acidity is slurried with water 20 and an alkaline salt 22 in step 10.

Alkaline salt 22 may be sodium carbonate, sodium bicarbonate, tris(hydroxymethyl)amino methane, or other salt which neutralizes the occluded acids released by grinding as well as acids on the surface of the crude explosive. Preferably, the alkaline salt has some buffering capacity, so that the resulting pH of the slurry will neither be very high nor very low if the ratio of added alkaline salt 22 to released acidity varies. The concentration of alkaline salt 22 in the slurry 24 should be relatively high and preferably constitutes a saturated solution.

The concentration of particulate explosive 18 in the slurry 24 is preferably as high as can be easily wet-ground in the subsequent size reduction step 12. For the nitramines RDX, HMX and CPX, a concentration of about 25 percent nitramine by weight has been found to work well, but lesser or greater concentrations may be utilized. Both equipment and operating costs are reduced by using less slurry volume.

The slurry 24 of explosive material is passed to a wet-grinding step 12 in which the particulate explosive material is fractured and ground to a reduced size. The occluded acidity is released and neutralized by the alkaline salt 22. Theoretically, the quantity of occluded acidity removed by grinding is dependent upon the extent of size reduction. It has been found that the rate of grinding as well as the rate of acidity reduction is increased by the addition of an alkaline salt such as sodium carbonate.

The wet grinding method used in this invention may comprise a method commonly used in current practice. In this procedure, a water slurry of the particulate explosive material is circulated in a piping system which includes pumps and orifices. The recirculation treatment is conducted for an extended period, typically 10–20 hours, to gently grind the explosive particles.

A preferred wet-grinding method is sonification at ultrasonic frequencies of 14 to 60 KHz. Power intensities are used which result in cavitation, i.e. gas bubble formation and intense collapse. The preferred frequencies are in the lower end of the scale, i.e. about 14–30 KHz, where cavitational shock intensity is higher. Exemplary output power intensities are in the range of about 70–120 watts per square centimeter, but levels lower and higher may also be used, provided cavitation of sufficient intensity to cause crystal fracture occurs. The optimum power level is dependent upon the particulate explosive hardness and its sensitivity to shock. The power level must not be so high as to cause detonation.

Figure 2:
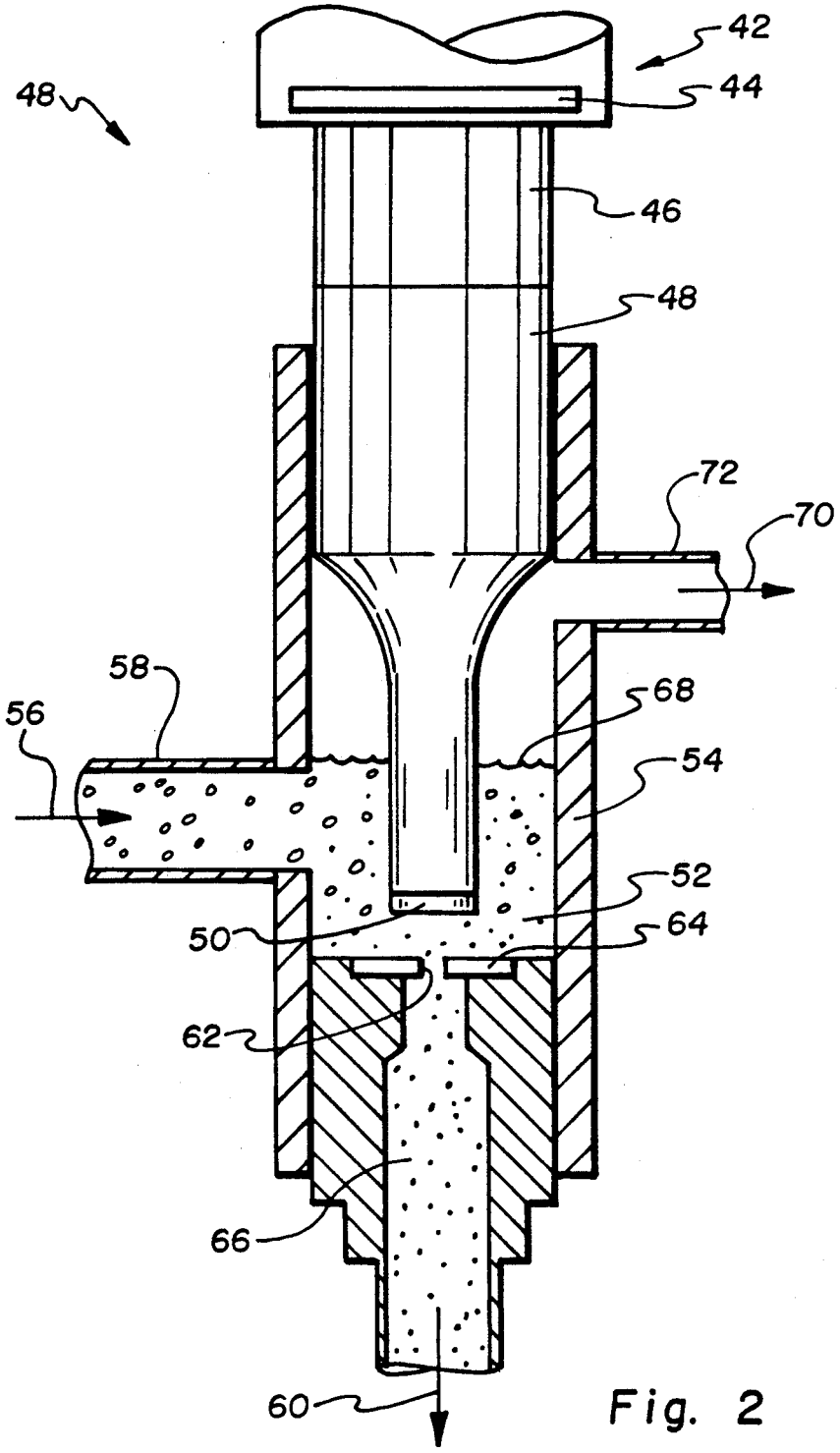
FIG. 2 is a partial sectional view of an ultrasonic treatment process for removing occluded acid in accordance with this invention.

FIG. 2 depicts an ultrasonic treatment apparatus 40 which is useful for continuous grinding of a particulate explosive material. The sonic generator 42 includes a transducer 44 and a sonic converter 46 which convert electrical energy to ultrasonic vibration in the tip 48 of the disruptor horn 50. The particular construction and operation of ultrasonic generators is well known in the art. The disruptor horn 50 is shown submerged in the slurry 52 of particulate explosive material within treatment chamber 54. A stream 56 of slurried explosive is introduced into the treatment chamber 54 from inlet conduit 58. A stream 60 of ground explosive material slurry 52 passes through orifice 62 in orifice plate 64 into outlet conduit 66. The orifice is sized to permit ground materials to pass through, and is located proximate the tip 50 so that all particles will be exposed to the cavitational forces generated by the tip.

If desired, the flowrate of slurry into the treatment chamber 54 may be adjusted to increase the liquid level 68 so that a portion 70 of the slurry overflows from the treatment chamber through overflow conduit 72. It may be recycled for further grinding or used for a different end product.

In an alternate arrangement, the flow direction shown in FIG. 2 is reversed, i.e. the inlet is at the bottom of the treatment chamber 24, and the outlet is on the side. Generally, the overflow conduit 44 is not then necessary.

Heat generated by the ultrasonic treatment requires that some cooling means be utilized. While not shown in FIG. 2, any means such as cooling coils in the walls of the treatment chamber, or a cooling bath may be used. Various means for the cooling of ultrasonic generators are known in the art.

The advantages of this method for removing acidity from explosive materials are as follows:

1. The removal of acidity and desired particle size are achieved simultaneously;
2. The treatment processing time is much reduced, by eliminating redissolution, recrystallization and dry-grinding steps;
3. Wet-grinding reduces the hazards associated with dry-grinding;
4. When the explosive material is to be used as a wet slurry, a further wetting step(following dry-grinding) is eliminated; and
5. Use of ultrasonic treatment greatly reduces the grinding time, enables closely controlled energy levels, and simplifies the process flowsheet.

EXAMPLE A

Five batches of a crude coproduced explosive (CPX) containing about 70 percent cyclotrimethylenetrinitramine (RDX) and about 30 percent cyclotetramethylenetetranitramine (HMX) had acidity concentrations, measured as percent nitric acid by method 102.3 of MIL-STD-650, as follows:

| | Acidity, Percent as Nitric Acid | | |
|---|---|---|---|
| Batch No. | Occluded Acid | Surface Acid | Total Acid |
| CPX2 | 0.675 | 0.005 | 0.680 |
| CPX4 | 0.561 | 0.010 | 0.571 |
| CPX5 | 0.637 | 0.007 | 0.644 |
| CPX6 | 0.668 | 0.006 | 0.674 |
| CPX9 | 0.432 | 0.006 | 0.438 |

Batch CPX6 was selected for evaluating the removal of acidity in accordance with the invention. Duplicate 10 gram samples of the CPX were each slurried in 30 grams of one of the following slurry media:

(a) distilled water
(b) sodium bicarbonate in distilled water (saturated solution at room temperature)
(c) sodium carbonate in distilled water (saturated solution at room temperature)
(d) tris(hydroxymethyl) amino methane in distilled water (saturated solution at room temperature)

Figure 3:
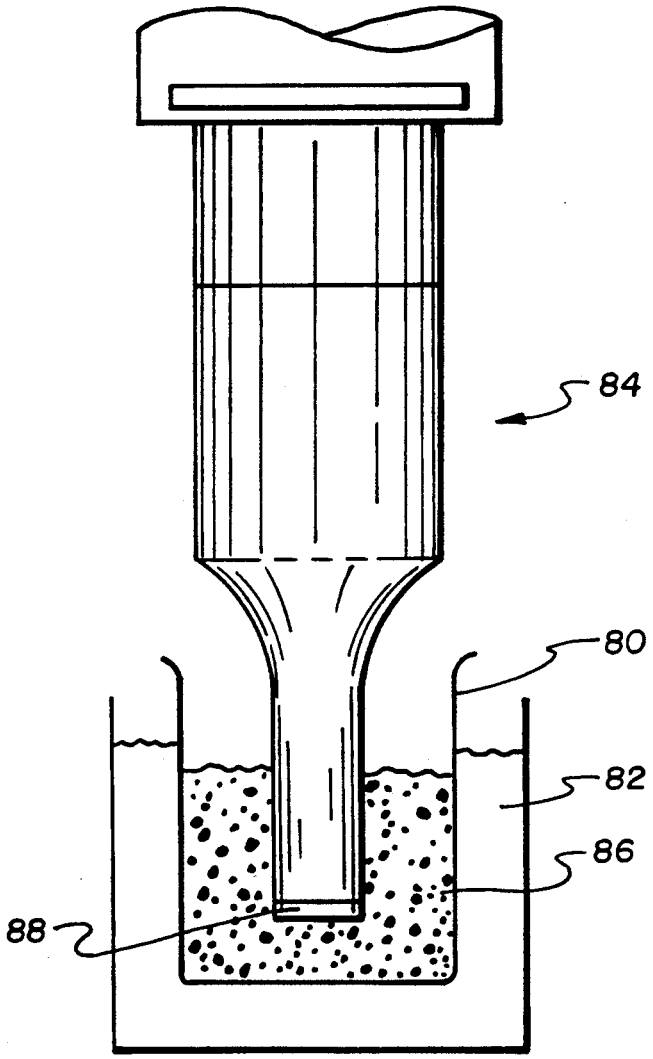
FIG. 3 is a partial section view of an ultrasonic generation apparatus used in the examples.

The batch grinding apparatus is illustrated in FIG. 3. For processing, the slurry sample was transferred to a beaker 80 placed in an ice bath 82. A Heat Systems-Ultrasonics Inc. Sonicator model number W385 ultrasonic probe with a 0.5 inch diameter tip 88 was inserted into the slurry sample 86 and operated for the designated time at a frequency of 20 KHz and a maximum power input of 385 watts. The effective power output intensity ranged from about 73 to 122 watts/square centimeter of generator tip area, depending upon the particular slurry medium being processed.

Following sonification treatment, each sample was filtered, rinsed with distilled water to pH 7.0, and dried in an oven at 100 degrees C. Occluded acidity was again determined as percent nitric acid, and the results were as follows:

| Processing Time, Min. | | Distilled Water | Sodium Bicarbonate | Sodium Carbonate | Tris (hydroxymethyl) Amino Methane |
|---|---|---|---|---|---|
| 5 | A | 0.58 | 0.34 | 0.35 | 0.33 |
| | B | 0.57 | 0.28 | 0.30 | 0.31 |
| | Ave. | 0.57 | 0.31 | 0.32 | 0.32 |
| 10 | A | 0.54 | 0.31 | 0.32 | 0.37 |
| | B | 0.55 | 0.21 | 0.25 | 0.30 |
| | Ave. | 0.54 | 0.26 | 0.28 | 0.34 |
| 20 | A | 0.51 | 0.19 | 0.18 | 0.20 |
| | B | 0.52 | 0.22 | 0.18 | 0.19 |
| | Ave. | 0.52 | 0.20 | 0.18 | 0.20 |
| 30 | A | 0.47 | 0.21 | 0.16 | 0.20 |
| | B | 0.49 | 0.22 | 0.16 | 0.14 |
| | Ave. | 0.48 | 0.22 | 0.16 | 0.17 |

The acidity of the CPX before sonification was as follows:

| | |
|---|---|
| A | 0.69 |
| B | 0.71 |
| Ave. | 0.70 percent |

Figure 4:
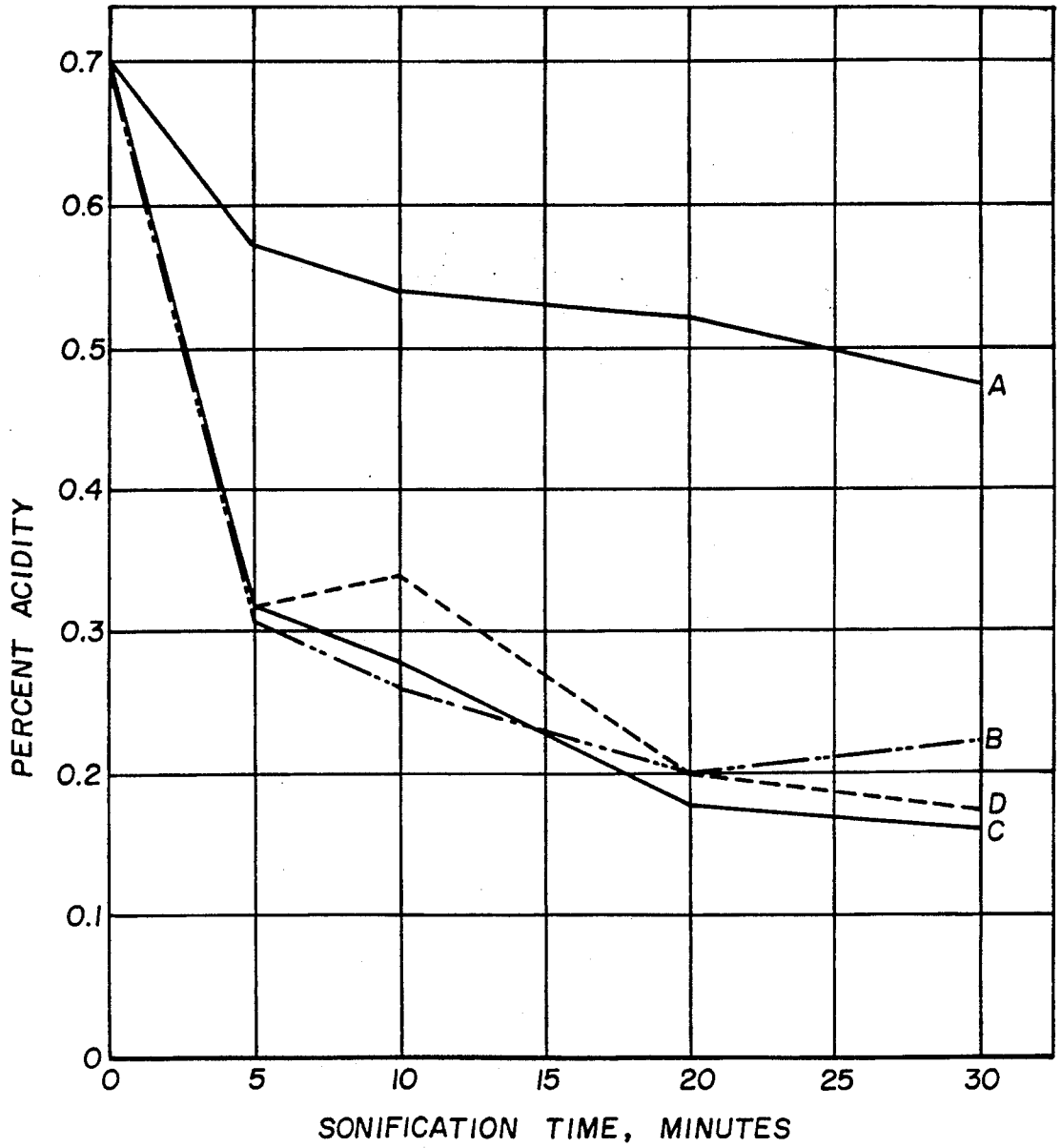
FIG. 4 is a graphical representation of the results of batch sonification tests, indicating the percent acidity in CPX as a function of sonification time.

The data are plotted in FIG. 4, and show the effect of sonification time and the use of alkaline salts upon reduction of occluded acidity. Curve A presents the results with distilled water only. The relatively small acidity reduction represents a slow rate of particle fracture. Curve B indicates the results with sodium bicarbonate as the alkaline salt. Curve C indicates the results using sodium carbonate, and Curve D shows the results with tris(hydroxymethyl)amino methane.

Each of the alkaline salts tested significantly increased the rate of acidity reduction. The use of sodium carbonate resulted in the lowest acidity, but the differences between the three alkaline agents was relatively small.

EXAMPLE B

Four 10 gram samples of CPX from Batch CPX6 were each slurried in a 30 gram portion of a saturated solution of sodium carbonate. Each portion was then subjected to a batch ultrasonic treatment as in Example A for a specific time period of 5, 10, 20 or 30 minutes. The sonified portions were then washed with distilled water to pH 7 and passed through a No. 325 U.S. Standard (44 micron) sieve. The percentages of solids passing through the sieve after each sonification period, as well as several other analyses, were as follows:

| Treatment Time, Minutes | % Passing Through #325 Sieve | % Acidity (as nitric) | % Alkalinity |
|---|---|---|---|
| 5 | 89.87 | 0.063 | — |
| 10 | 96.63 | 0.025 | — |
| 20 | 97.52 | — | 0.12 |
| 30 | 99.11 | — | 0.12 |

This test indicated that in a saturated sodium carbonate slurry, CPX was readily ground to a particle size wherein 96+ percent passed through a #325 sieve in only 10 minutes. The residual occluded acidity was only 0.025 percent (as nitric acid). It is expected that grinding to even smaller particle size will result in less residual acidity.

Reference herein to details of the illustrated embodiments is not intended to restrict the scope of the appended claims which themselves recite those features which are regarded as important to the invention.

What is claimed is:

1. A method for removing occluded acidity from particulate explosive material, comprising: slurrying said particulate explosive material in an inert liquid;

passing said slurry proximate and an ultrasonic generator to grind said slurried particulate explosive material in the wet state to simultaneously reduce the particle size to said explosive material, release said occluded acidity from said explosive material, and dissolve said released acidity in said inert liquid; and recovering said explosive material of reduced particle size and reduced occluded acidity from said slurry.

2. The method of claim 1, further comprising the step of adding to said inert liquid an acid neutralizing material.

3. The method of claim 2, wherein said acid neutralizing material comprises an alkaline salt.

4. The method of claim 3, wherein said further step comprises adding an acid neutralizing material comprising one or more of sodium carbonate, sodium bicarbonate, or tris(hydroxymethyl)amino methane to neutralize said acidity.

5. The method of claim 4, wherein said acid neutralizing material is added to said inert liquid to create a saturated or nearly saturated solution.

6. The method of claim 1, wherein said grinding step is conducted at a temperature maintained below 50 degrees C.

7. The method of claim 1, wherein said grinding step comprises passage of said slurry of particulate explosive material proximate an ultrasonic generator operating at 14–60 KHz frequency.

8. The method of claim 1, wherein said grinding step comprises passage of said slurry of particulate explosive material proximate an ultrasonic generator operating at 14–30 KHz.

9. The method of claim 1, wherein said ultrasonic generator is operating with an output power intensity of at least 70 watts per square centimeter generator tip area.

10. A method for removing occluded acidity from a particulate nitramine material, comprising: slurrying said particulate nitramine material in an inert aqueous liquid;

passing said slurry proximate and an ultrasonic generator to grind said slurried nitramine material in the wet state to simultaneously reduce the particle size to a final desired size distribution, release said occluded acidity from said nitramine material, and neutralize said released acidity; and separating said ground particulate nitramine material from said aqueous liquid; and water-washing said separated ground particulate nitramine material to remove traces of non-nitramine material.

11. The method of claim 10, wherein said inert aqueous liquid is a saturated or nearly-saturated solution of an alkaline salt.

12. The method of claim 10, wherein said particulate nitramine material comprises one or more of particulate unrecrystallized RDX and HMX from a crude crystallization step.

13. The method of claim 10, wherein said particulate nitramine is CPX comprising about 70% RDX and about 30% HMX.

14. The method of claim 10, wherein said slurried nitramine material is ground in the wet state by subjection to acoustic cavitation produced by an ultrasonic generator operating at 14–60 KHz.

15. The method of claim 14, wherein said ultrasonic generator is operated with an output power intensity of at least 70 watts per square cm. generator tip area.

* * * * *